US008920105B2

(12) United States Patent
Moriguchi et al.

(10) Patent No.: US 8,920,105 B2
(45) Date of Patent: Dec. 30, 2014

(54) ROTATION-TYPE CONSTRUCTION MACHINE

(75) Inventors: Kosuke Moriguchi, Tsuchiura (JP); Katsuhiro Sasaki, Tsuchiura (JP); Junya Kawamoto, Tsuchiura (JP); Yasuhiro Miyahara, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/128,898

(22) PCT Filed: Jun. 18, 2012

(86) PCT No.: PCT/JP2012/065499

§ 371 (c)(1),
(2), (4) Date: Dec. 23, 2013

(87) PCT Pub. No.: WO2012/176729

PCT Pub. Date: Dec. 27, 2012

(65) Prior Publication Data

US 2014/0140799 A1 May 22, 2014

(30) Foreign Application Priority Data

Jun. 24, 2011 (JP) ..... 2011-140930

(51) Int. Cl.

| | |
|---|---|
| ***E02F 3/00*** | (2006.01) |
| ***E02F 9/12*** | (2006.01) |
| ***E02F 9/22*** | (2006.01) |
| ***E02F 3/30*** | (2006.01) |
| *E02F 9/08* | (2006.01) |
| *E02F 3/32* | (2006.01) |
| *E02F 3/38* | (2006.01) |

(52) U.S. Cl.

CPC ..... *E02F 9/123* (2013.01); *E02F 9/2275* (2013.01); *E02F 3/30* (2013.01); *E02F 9/0875* (2013.01); *E02F 3/325* (2013.01); *E02F 3/384* (2013.01); *E02F 9/121* (2013.01); *Y10S 37/902* (2013.01)

USPC ..... 414/695.5; 37/902

(58) Field of Classification Search

CPC ..... E02F 3/7627; E02F 3/786; E02F 9/2275; E02F 9/2271

USPC ..... 414/695.5; 37/902

See application file for complete search history.

(56) References Cited

U.S. PATENT DOCUMENTS

| | | | | | |
|---|---|---|---|---|---|
| 2,903,145 | A | * | 9/1959 | Brinkel | 414/744.2 |
| 3,082,890 | A | * | 3/1963 | Auwelaer et al. | 414/695 |
| 3,120,897 | A | * | 2/1964 | Auwelaer et al. | 414/694 |
| 3,236,394 | A | * | 2/1966 | McMullen | 414/695 |
| 2004/0187366 | A1 | * | 9/2004 | Yoshida et al. | 37/407 |

FOREIGN PATENT DOCUMENTS

| | | | | | |
|---|---|---|---|---|---|
| JP | 2004-36233 | A | | 2/2004 | |
| JP | 2004036233 | A | * | 2/2004 | E02F 9/00 |
| JP | 2004036234 | A | * | 2/2004 | E02F 9/00 |
| JP | 2004-100173 | A | | 4/2004 | |
| JP | 2004100173 | A | * | 4/2004 | E02F 9/00 |
| JP | 2004-353401 | A | | 12/2004 | |
| JP | 2004353401 | A | * | 12/2004 | E02F 9/00 |
| JP | 2005-60977 | A | | 3/2005 | |
| JP | 2005060976 | A | * | 3/2005 | E02F 9/00 |
| JP | 2005060977 | A | * | 3/2005 | E02F 9/00 |
| JP | 2007239455 | A | * | 9/2007 | |
| JP | 2008202238 | A | * | 9/2008 | |

OTHER PUBLICATIONS

International Search Report dated Sep. 4, 2012 with English translation (four (4) pages).

* cited by examiner

*Primary Examiner* — Gerald McClain
(74) *Attorney, Agent, or Firm* — Crowell & Moring LLP

(57) ABSTRACT

To provide a swing-type construction machine that can reduce force of working device pipes which is generated in accordance with swinging of a working device and presses against a side wall of a swing post. The present invention is configured such that a swing frame side holding body for holding a part of working device pipes 21, which is located at a side of a swing frame 2*a*, includes a first clamp 22 having a first stage holding portion that clamps one of the group of the working device pipes and a second stage holding portion that is arranged on a position lower than the first stage holding portion and clamps the other group of the working device pipes, while a swing post side holding body for holding a part of the working device pipes 21, which is located at a side of a swing post 6, includes a second clamp 24 having a first stage holding portion that clamps the group of the working device pipes that are clamped, by the first stage holding portion of the first clamp 22 and a second stage holding portion that clamps the group of the working device pipes that are clamped by the second stage holding portion of the first clamp 22.

4 Claims, 10 Drawing Sheets

CONVENTIONAL ART

CONVENTIONAL ART

ROTATION-TYPE CONSTRUCTION MACHINE

TECHNICAL FIELD

The present invention relates to a swing-type construction machine such as a compact excavator, etc. in which a plurality of working device pipes are inserted into a horizontal hole that is formed in a swing post of the machine.

BACKGROUND ART

Regarding the techniques above, JP 2004-36233 A (Patent document 1) describes the prior arts. FIG. 12 is a perspective view of a main part of a conventional swing-type construction machine, which is described in JP 2004-36233 A. The swing-type construction machine having the main part illustrated in FIG. 12 is, for example, a compact excavator that constitutes a small-sized construction machine. The compact excavator is provided with a working device (not shown) for digging work of earth and sand, etc. including a boom, an arm, and a bucket, and a boom cylinder, an arm cylinder, and a bucket cylinder that are hydraulic actuators for driving the boom, the arm, and the bucket, respectively. Moreover, the compact excavator is provided with a swing cylinder (not shown) for swinging the working device in a horizontal direction, a swing post 52 illustrated in FIG. 12 which is rotatable in a horizontal direction and to which the working device is attached, a bracket 51 that is connected to the swing post 52 via a vertically extended connecting pin 53, and a upperstructure having a swing frame 50 on which the bracket 51 is fixed. The compact excavator is further provided with a control valve (not shown) that is arranged on the upperstructure and a plurality of working device pipes 54 that connect the control valve and the corresponding ones of the plurality of the hydraulic actuators included in the working device.

Still further, the compact excavator according to the conventional techniques is provided with a swing frame side holding body that holds a part of the plurality of the working device pipes 54, which is located at a side of the swing frame 50, that is, a pipe holding bracket 55, and a swing post side holding body that holds a part of the plurality of the working device pipes 54, which is located at a side of the swing post 52, that is, a clamp 56. As illustrated in FIG. 12, the swing post 52 includes a horizontal hole 52*a* into which the plurality of the working device pipes 54 are inserted toward an opposite side of a swing cylinder (not shown) across the connecting pin 53.

As illustrated in FIG. 12, in the compact excavator according to the conventional techniques, between the pipe holding bracket 56 to the horizontal hole 52*a* of the swing post 52, the plurality of the working device pipes 54 are arranged so as to extend along a horizontal direction as if they are bundled and concentrated. When inserting the working device pipes 54 into the horizontal hole 52*a* of the swing post 52, they are inserted therein so as to wrap around the connecting pin 53. At a position upper than a position where the working device pipes 54 are inserted into the horizontal hole 52*a* of the swing post 52, an extending direction of the working device pipes 54 is reversed. In this state, the working device pipes 54 are clamped by the clamp 56 so that the working device pipes 54 extend upwardly thereafter.

The respective working device pipe 54 are set to have length that enables a swing cylinder (not shown) to swing. The techniques according to JP 2004-36233 A were invented by the same inventors as those of the present application, and although not mentioned in JP 2004-36233 A, a holding form of the working device pipes 54 in the pipe holding bracket 55 and a holding form of the working device pipes 54 in the clamp 56 are actually configured as the ones illustrated in FIG. 13 and FIG. 14 of the present application, respectively. Hereinafter, the holding forms of the working device pipes 54 will be described.

At an inner portion, which is located at a side of the center line of rotation of the upperstructure, of the pipe holding bracket 55 for holding the plurality of the working device pipes 54 on a side of the swing frame 50, holes 55*a* and 55*b* into which two boom pipes to be connected to the boom cylinder are respectively inserted and a hole 55*c* into which one of the two arm pipes to be connected to the arm cylinder is inserted are arranged. At a center portion of the pipe holding bracket 55, holes 55*d* and 55*e* into which two bucket pipes to be connected to the bucket cylinder are respectively inserted and a hole 55*f* into which the other one of the arm pipes is inserted are arranged. Furthermore, at an outer portion of the pipe holding bracket 55, holes 55*g* and 55*h* into which two spare pipes to be connected to a spare actuator are inserted are arranged.

As illustrated in FIG. 14, the clamp 56 for holding the working device pipes 54 on a side of the swing post 52 is configured by a first clamping portion 57 and a second clamping portion 58 that are mutually opposed. Between the first clamping portion 57 and the second clamping portion 58, in a direction from a side of the swing cylinder to a side of the horizontal hole 52*a* of the swing post 52, holes 56*a* and 56*b* into which the two boom pipes are respectively inserted, a hole 56*c* into which one of the two arm pipes is inserted, two holes 56*d* and 56*e* into which the two bucket pipes are respectively inserted, a hole 56*f* into which the other one of the two arm pipes is inserted, and holes 56*g* and 56*h* into which the spare pipes are respectively inserted are formed.

In this way, in the holding form in which the working device pipes 54 are held by the pipe holding bracket 55 and the clamp 56, a state where the working device pipes 54 including the plurality of the boom pipes, the arm pipes, the bucket pipes, and the spare pipes are bundled and concentrated is maintained near the connecting pin 53, and while keeping this state, the working device pipes 54 are inserted into the horizontal hole 52*a* of the swing post 52.

PRIOR ART DOCUMENT

Patent Document

Patent Document 1: Japanese Patent Application Laid-Open No. 2004-36233 A

SUMMARY

Problems to be Solved by the Invention

In the conventional techniques according to JP 2004-36233 A described above, the working device pipes 54 are inserted into the horizontal hole 52*a* of the swing post 52 in a state where they are bundled and concentrated as one group. Accordingly, when swinging a working device (not shown) toward a direction opposite to a side of the swing cylinder, force that is generated in accordance with an operation, in which the boom pipes located at the inner side and the arm pipes and the bucket pipes located at the center side respectively expand outwardly, does not escape and is easily transmitted to the spare pipes located at the outer side. For the reason above, in the conventional techniques, there is a problem that the pipes located at the outer side are pressed against the edge, etc. of the horizontal hole 52*a* of the swing post 52 with strong force. If such a problem happens repeatedly, it may cause deterioration of durability of the working device pipes 54.

The present invention was made in view of such problems stemming from the conventional technique described above, and an object of the present invention is to provide a swing-type construction machine that can reduce force of working device pipes which is generated in accordance with swinging of a working device and presses against an edge, etc. of a horizontal hole of a swing post.

In order to achieve the object described above, the present invention provides a swing-type construction machine comprising: a working device including a plurality of hydraulic actuators; a swing cylinder that swings the working device in a horizontal direction; a swing post that is rotatable in a horizontal direction and on which the working device is mounted; a bracket that is connected to the swing post via a vertically extended connecting pin; a upperstructure having a swing frame on which the bracket is fixed; a control valve that is arranged on the upperstructure; a plurality of working device pipes that connect the control valve with corresponding ones of the plurality of hydraulic actuators; a swing frame side holding body that holds a part of the plurality of the working device pipes which is located at a side of the swing frame; and a swing post side holding body that holds a part of the plurality of the working device pipes which is located at a side of the swing post, the swing post having a horizontal hole into which the plurality of the working device pipes are inserted and is arranged on a position of an opposite side of a swing cylinder across the connecting pin; and the plurality of the working device pipes being arranged such that they extend along a horizontal direction between the swing frame side holding body and the horizontal hole of the swing post, and when inserting the plurality of the working device pipes into the horizontal hole of the swing post, the plurality of the working device pipes are inserted therein so as to wrap around the connecting pin, and at a position upper than a position where the plurality of the working device pipes are inserted into the horizontal hole of the swing post, an extending direction of the plurality of the working device pipes is reversed, and in the reversed state, the plurality of the working device pipes are clamped by the swing post side holding body so that the plurality of the working device pipes extend upwardly thereafter, wherein, the swing frame side holding body is configured by a first clamp that is provided with a plurality of stages of holding portions including a first stage holding portion and a second stage holding portion, and the plurality of the stages of the holding portions respectively clamp corresponding pipes of the the plurality of the working device pipes, and the swing post side holding body is configured by a second clamp having a first stage holding portion for clamping the plurality of the working device pipes that are clamped by the first stage holding portion of the first clamp and a second stage holding portion for clamping the plurality of the working device pipes that are clamped by the second stage holding portion of the first clamp.

The present invention is configured as above, and accordingly the plurality of the working device pipes to be inserted into the horizontal hole of the swing post are held basically in a two-stage group of working device pipes in a vertical direction by cooperation of the first clamp and the second clamp. There is a case in which, when the plurality of the working device pipes expand outwardly along with an operation in which the working device swings in an opposite direction against a side of a swing cylinder (not shown), the mutually adjacent working device pipes in a group of the working device pipes on the same upper row of the first clamp, which includes the spare pipe, the arm pipe, the bucket pipe, and the boom pipe, come in contact with each other, or the mutually adjacent working device pipes in a group of the working device pipes on the same lower row of the second clamp, which includes the spare pipe, the bucket pipe, the arm pipe and the boom pipe, come in contact with each other. Even in such the case, with the configuration according to the present embodiment, sliding between the pipes is easily generated, and this siliding makes it possible to suppress transmission of force that is generated in accordance with the expanding action. Therefore, when the plurality of the working device pipes respectively expand outwardly along with a swing operation of the working device, transmission of force to the spare pipes and, etc. that are located more outside than the other working device pipes, which is generated in accordance with the expanding action of the working device pipes that are located inside are suppressed. That is, it is possible to reduce force of the working device pipes, which is generated along with a swing operation of the working device and presses against an edge, etc. of the horizontal hole of the swing post.

Furthermore, according to the present invention, the swing-type construction machine according to the present invention further comprises a cover, wherein the cover is provided for fixing the first clamp on the bracket and is arranged on the swing post, and the second clamp is fixed thereon to be covered thereby.

Furthermore, according to the present invention, the first clamp is configured by a rubber and a holding metal fitting, the rubber is provided with holes that constitute the first stage holding portion and the second stage holding portion of the first clamp and the holes into which the plurality of working device pipes are inserted are arranged in a row in a horizontal direction, the holding metal fitting holds the rubber so as not to expand the rubber and is fixed on the bracket, the second clamp is configured by a rubber and a holding metal fitting, the rubber of the second clamp is provided with holes that constitute the first stage holding portion and the second stage holding portion of the second clamp and the holes into which the plurality of working device pipes are inserted are arranged in a row in a horizontal direction, and the holding metal fitting of the second clamp holds the rubber of the second clamp so as not to expand the rubber of the second clamp and is fixed on the cover.

Furthermore, according to the present invention, the swing-type construction machine is a compact excavator that constitutes a small-sized construction machine, the working device includes a boom that is attached to the swing post swingably in a vertical direction, an arm that is attached to a top portion of the boom swingably in a vertical direction, and a bucket that is attached to a top portion of the arm swingably in a vertical direction, the working device is also provided with a boom cylinder for driving the boom, an arm cylinder for driving the arm, and a bucket cylinder for driving the bucket that constitute hydraulic actuators, the swing post includes a mounting portion of the swing cylinder on a position opposite to a side of the horizontal hole across the connecting pin, and the working device pipes include a boom pipe to be connected to the boom cylinder, an arm pipe to be connected to the arm cylinder, and a bucket pipe to be connected to the bucket cylinder.

Furthermore, according to the present invention, the swing-type construction machine is configured such that it includes the two boom pipes, the two arm pipes, and the two bucket pipes, in the first clamp, one of the two boom pipes, one of the two arm pipes, and one of the two bucket pipes are inserted into the holes that constitute the first stage holding portion of the first clamp, while the other one of the two boom pipes, the other one of the two arm pipes, and the other one of the two bucket pipes are inserted into the holes that constitute the second stage holding portion of the first clamp, and in the second clamp, the boom pipe, the arm pipe, and the bucket pipe that are inserted into the holes that constitute the first stage holding portion of the first clamp and the arm pipe that is inserted into the hole that constitutes the second stage holding portion of the first clamp are inserted into the holes that constitute the first stage holding portion of the second clamp, while the boom pipe and the bucket pipe that are inserted into the holes that constitute the second stage holding portion of the first clamp are inserted into the holes that constitute the second stage holding portion of the second clamp.

Effect of the Invention

The present invention is configured such that a swing frame side holding body for holding a part of working device pipes, which is located at a side of a swing frame, includes a first clamp having a first stage holding portion that clamps one of the group of the working device pipes and a second stage holding portion that is arranged on a position lower than the first stage holding portion and clamps the other group of the working device pipes, while a swing post side holding body for holding a part of the working device pipes, which is located at a side of a swing post, includes a first stage holding portion that clamps the group of the working device pipes that are clamped by the first stage holding portion of the first clamp and a second stage holding portion that clamps the group of the working device pipes that are clamped by the second stage holding portion of the first clamp. In the configuration according to the present invention, a group of the multiple working device pipes are arranged in a vertical direction within the swing post. Accordingly, when swinging the working device in a direction opposite to a side of the swing cylinder, even if the working device pipes that are included in an upper group of the working device pipes come into contact with the working device pipes that are included in a lower group of the working device pipes, sliding therebetween can be generated. In this way, it is possible to reduce force of the working device pipes, which is generated along with a swing operation of the working device and presses against an edge, etc. of the horizontal hole of the swing post, and therefore, the present embodiment can improve durability of the working device pipes as compared with a conventional one.

DESCRIPTION OF EMBODIMENTS

Hereinafter, an embodiment of a swing-type construction machine according to the present invention will be described with reference to the drawings.

Figure 1:
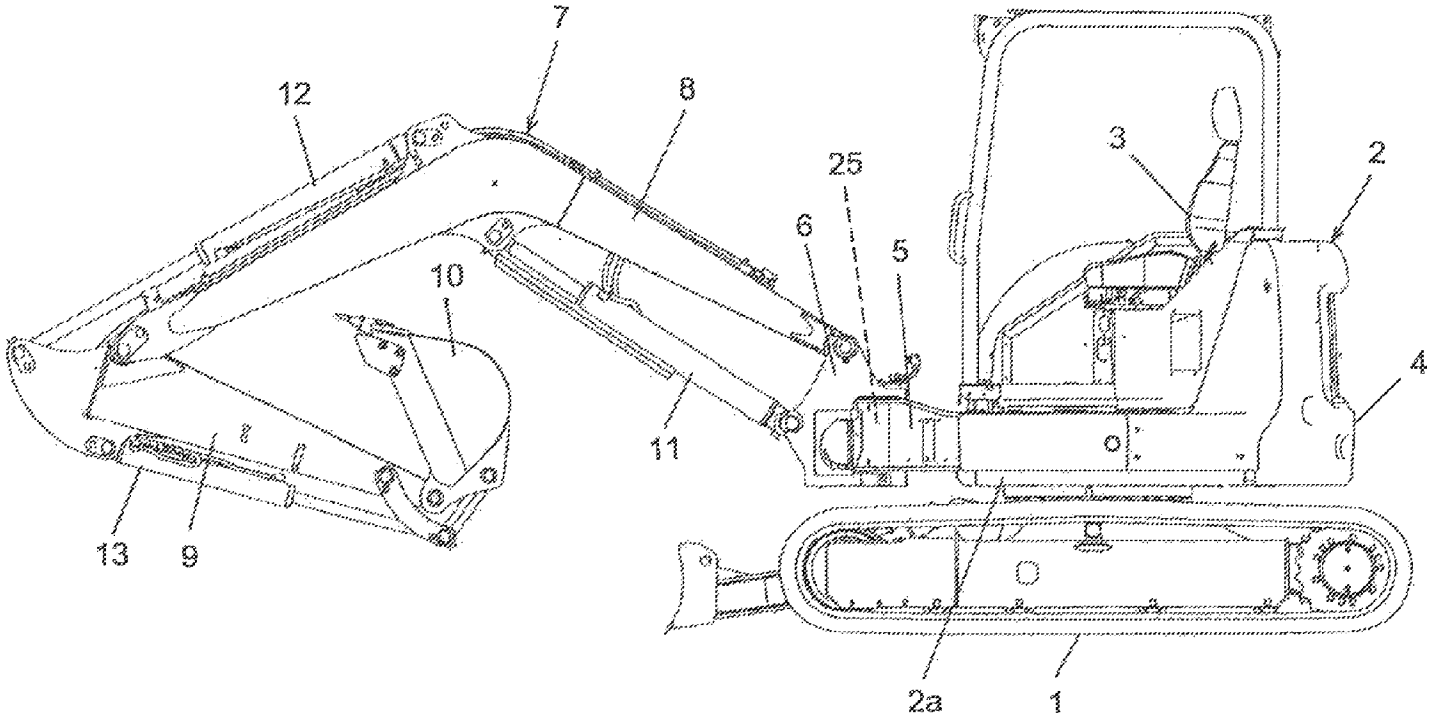
FIG. 1 is a side view of a compact excavator illustrated as an embodiment of a swing-type construction machine according to the present invention.

A swing-type construction machine according to an embodiment of the present invention is, for example, a compact excavator that constitutes a small sized construction machine. As illustrated in FIG. 1, the compact excavator includes an undercarriage 1, a upperstructure 2 that is arranged on the undercarriage 1, an operator's cab 3 that is arranged on a swing frame 2*a* of the upperstructure 2, and a counterweight 4 that is arranged at a rear end portion of the swing frame 2*a*. The compact excavator is also provided with a working device 7 for digging work of earth and sand, etc., a swing post 6 to which the working device 7 is attached and formed swingably in a horizontal direction, and a bracket 5 that is connected to the swing post 6 via a vertically extended connecting pin 25 and is fixed on the swing frame 2*a*.

The working device 7 includes a boom 8 that is attached to the swing post 6 swingably in a vertical direction, an arm 9 that is attached to a top portion of the boom 8 swingably in a vertical direction, and a bucket 10 that is attached to a top portion of the arm 9 swingably in a vertical direction. The working device 7 is also provided with a boom cylinder 11 for driving the boom 8, of which one end is connected to the swing post 5 and the other end is connected to the boom 8, an arm cylinder 12 for driving the arm 9, of which one end is connected to the boom 8 and the other end is connected to the arm 9, and a bucket cylinder 13 for driving the bucket 10, of which one end is connected to the arm 9 and the other end is connected to the bucket 10. The boom cylinder 11, the arm cylinder 12, and the bucket cylinder 13 constitute hydraulic actuators that are included in the working device 7.

Figure 3:
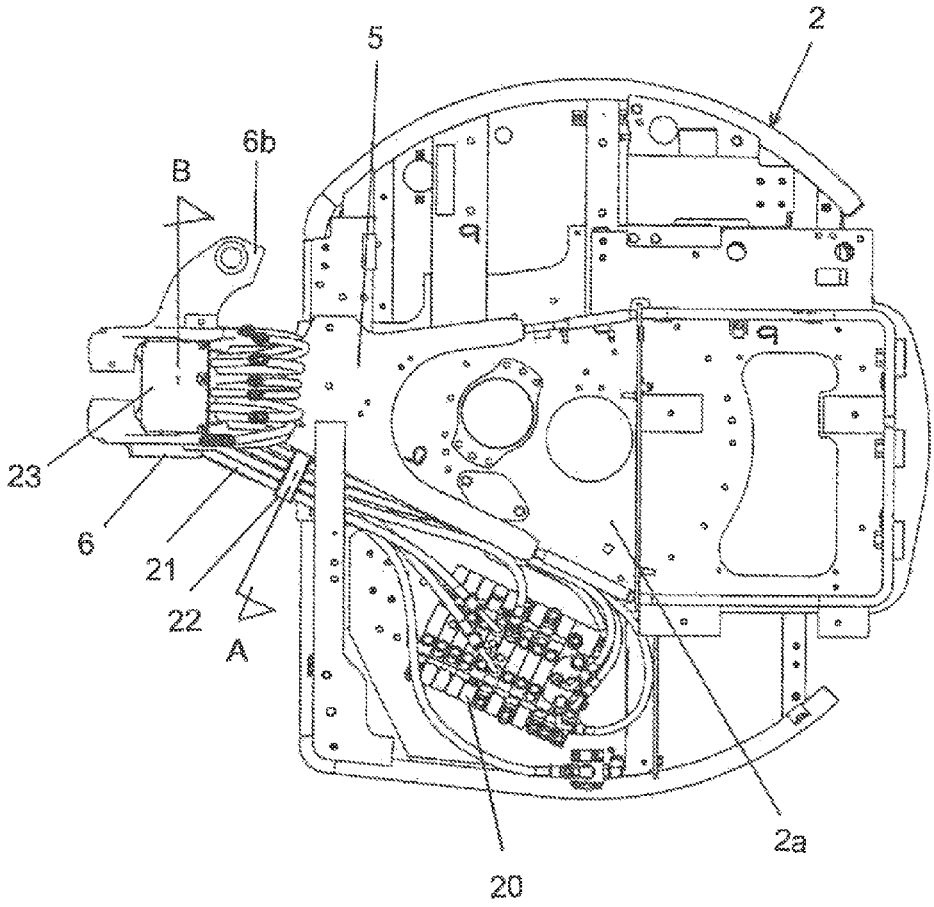
FIG. 3 is a plain view of a main part of an embodiment according to the present invention.

As illustrated in FIG. 3, etc., the swing post 6 is provided with a mounting portion 6*b* on which a swing cylinder (not shown) is mounted. Also as illustrated in FIG. 3, etc., in the compact excavator, the hydraulic actuators such as the boom cylinder 11, the arm cylinder 12, and the bucket cylinder 13, a swing motor (not shown) for swinging the upperstructure 2, and a control valve 20 for controlling flow of pressure oil to be fed to a travel motor (not shown) that makes the undercarriage 1 travel are arranged on a left side of the swing frame 2*a* of the upperstructure 2 in a direction toward the working device 7.

Figure 4:
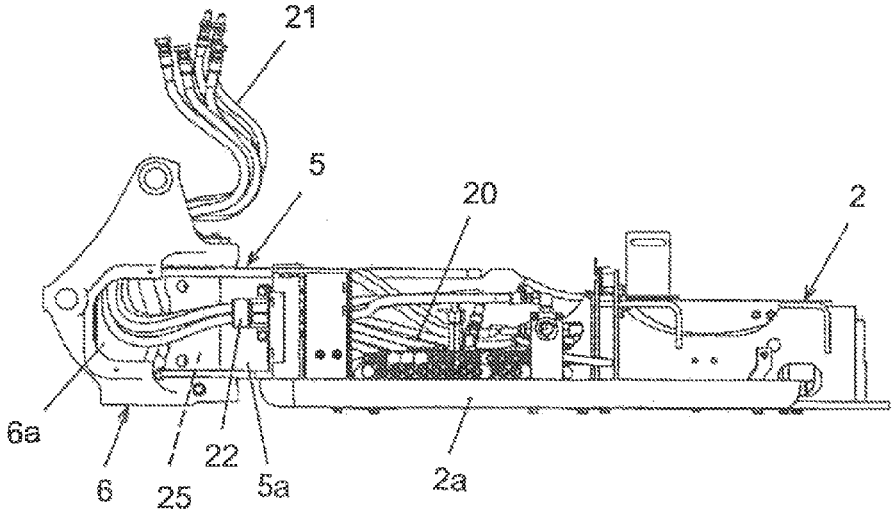
FIG. 4 is a side view of a main part of an embodiment according to the present invention.

As illustrated in FIGS. 2 to 5, the compact excavator is provided with a plurality of working device pipes 21 that connect the boom cylinder 11, the arm cylinder 12, and the bucket cylinder 13 with the control valve 20. The working device pipes 21 include, for example, two spare pipes 21*a* and 21*b*, two arm pipes 21*c* and 21*f*, two bucket pipes 21*d* and 21*e*, and two boom pipes 21*g* and 21*h*. As illustrated in FIG. 4, the swing post 6 includes a horizontal hole 6*a*, into which the plurality of the working device pipes 21 are inserted, formed thereon on an opposite side of a swing cylinder (not shown) across the connecting pin 25.

Figure 6:
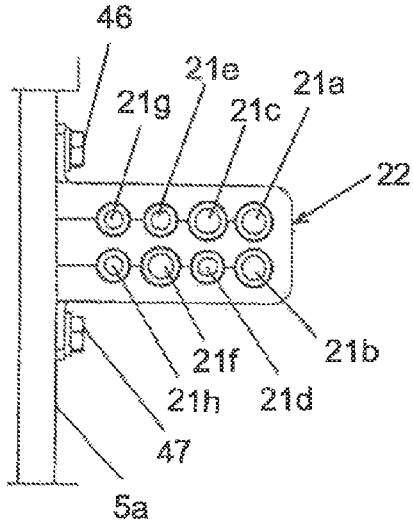
FIG. 6 is an enlarged view of a cross section A illustrated in FIG. 3.
Figure 7:
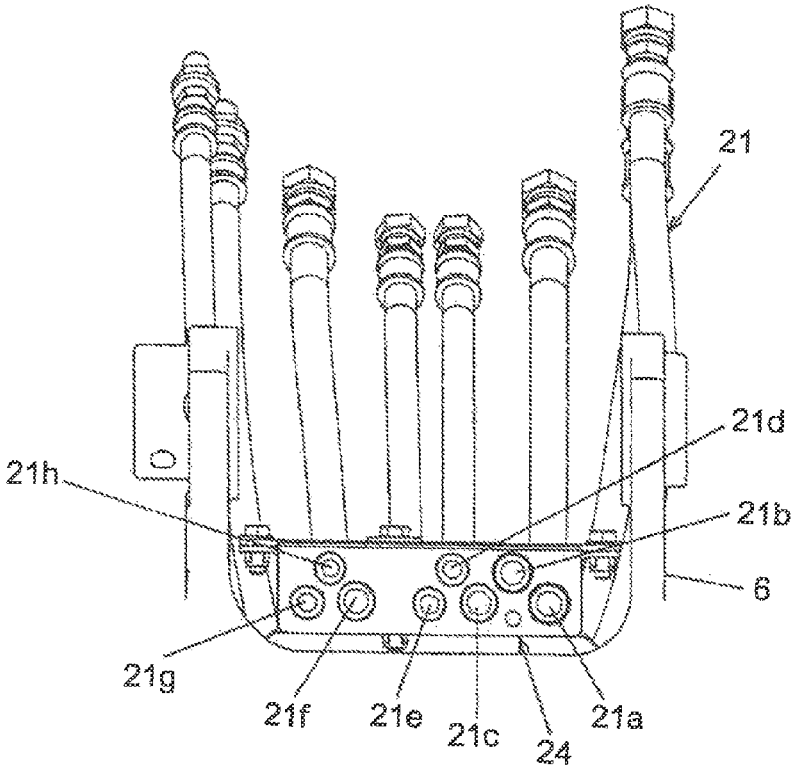
FIG. 7 is an enlarged view of a cross section B illustrated in FIG. 3.

As illustrated in FIGS. 6 and 7, the compact excavator is provided with a swing frame side holding body for holding a part of the plurality of the working device pipes 21, which is located at a side of the swing frame 2*a*, that is, a first clamp 22, and a swing post side holding body for holding a part of the plurality of the working device pipes 21, which is located at a side of the swing post 6, that is, a second clamp 24.

Figure 2:
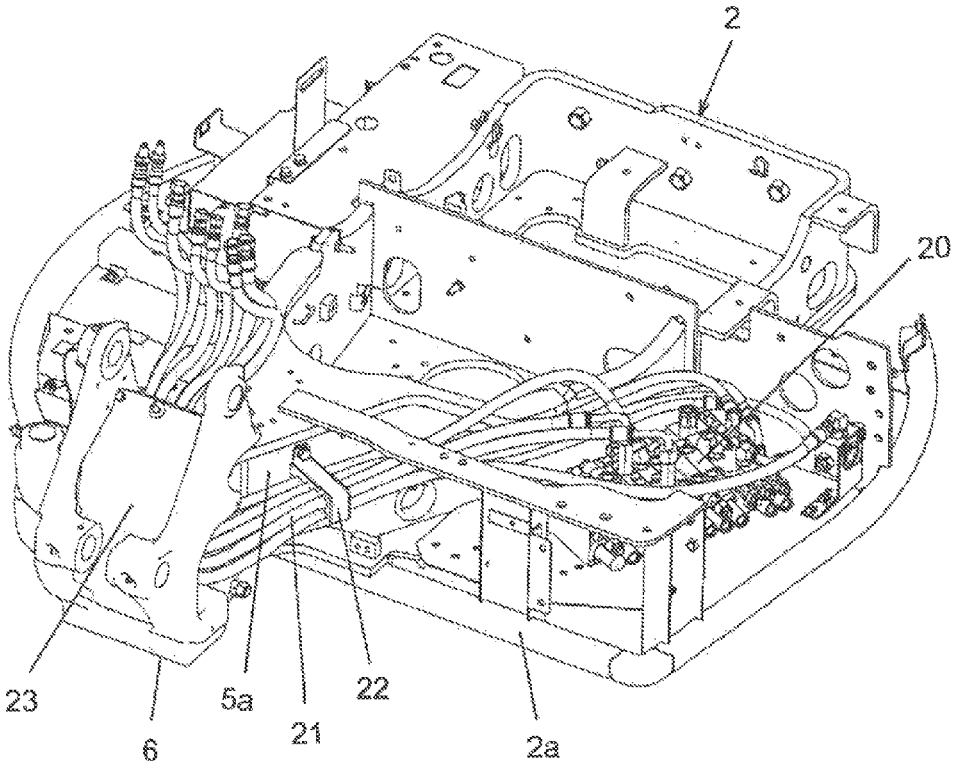
FIG. 2 is a perspective view of a main part of an embodiment according to the present invention.

In FIGS. 2 and 4, etc., a basic holding form of the plurality of the working device pipes 21 is illustrated. That is, they are arranged so as to extend along a horizontal direction between the first clamp 22 and the horizontal hole 6*a* of the swing post 6. When inserting the working device pipes 21 into the horizontal hole 6*a* of the swing post 6, they are inserted therein so as to wrap around the connecting pin 25. At a position upper than a position where the working device pipes 21 are inserted into the horizontal hole 6*a* of the swing post 6, an extending direction of the working device pipes 21 is reversed. In this state, the working device pipes 21 are clamped by the second clamp 24 so that the pipes 21 are extended upwardly thereafter to be connected to the corresponding hydraulic actuators.

Figure 8:
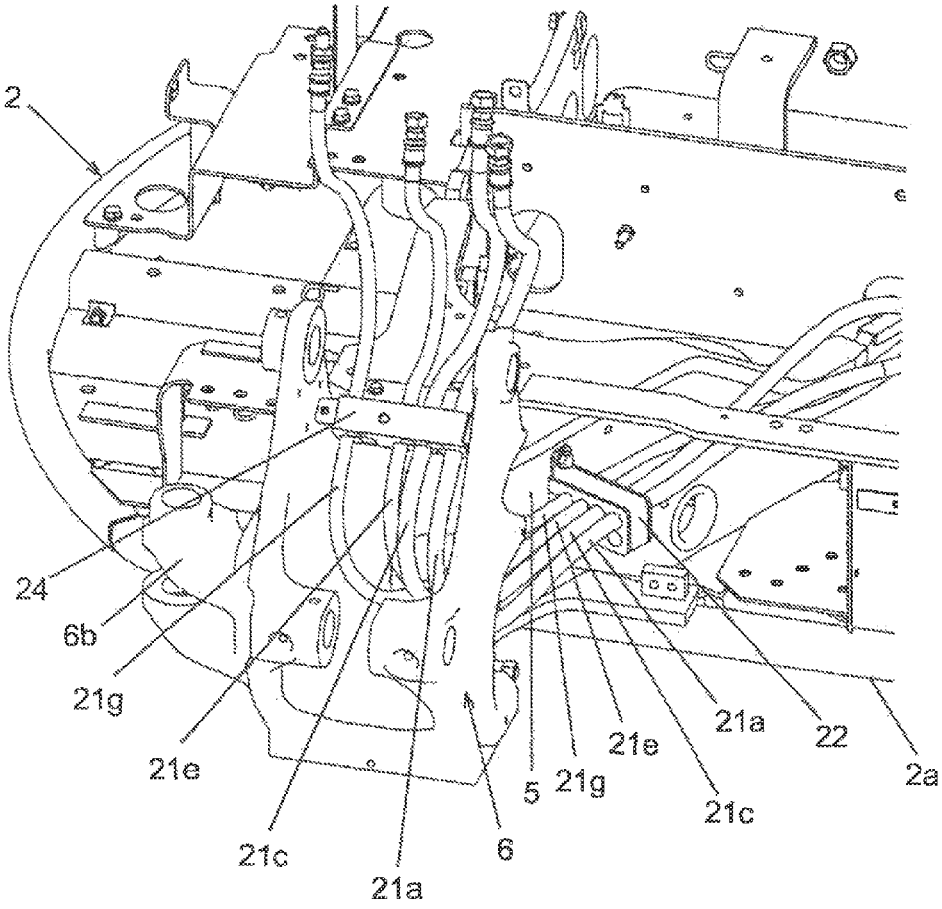
FIG. 8 is a perspective view of an attachment form of one group of working device pipes that are included in the present embodiment.

As illustrated in FIGS. 6 and 8, the first clamp 22 is provided with a plurality of stages of holding portions including a first stage holding portion and a second stage holding portion that is disposed on a position lower than the first stage holding portion. The first stage holding portion clamps one of the group of the working device pipes including the boom pipe 21*g*, the bucket pipe 21*e*, the arm pipe 21*c*, and the spare pipe 21*a* that are arranged on the same row on the first clamp 22 in a horizontal direction from an inner side of the first clamp 22 as a side of the center line of rotation of the upperstructure 2 toward an outer side thereof. The second stage holding portion clamps the other group of the working device pipes including the boom pipe 21*h*, the arm pipe 21*f*, the bucket pipe 21*d*, and the spare pipe 21*b* that are arranged on the same row on the first clamp 22 in a horizontal direction from the inner side as a side of the center line of rotation of the upperstructure 2 toward an outer side thereof. In the present embodiment, the first clamp 22 includes, for example, the first stage holding portion and the second stage holding portion only.

Figure 9:
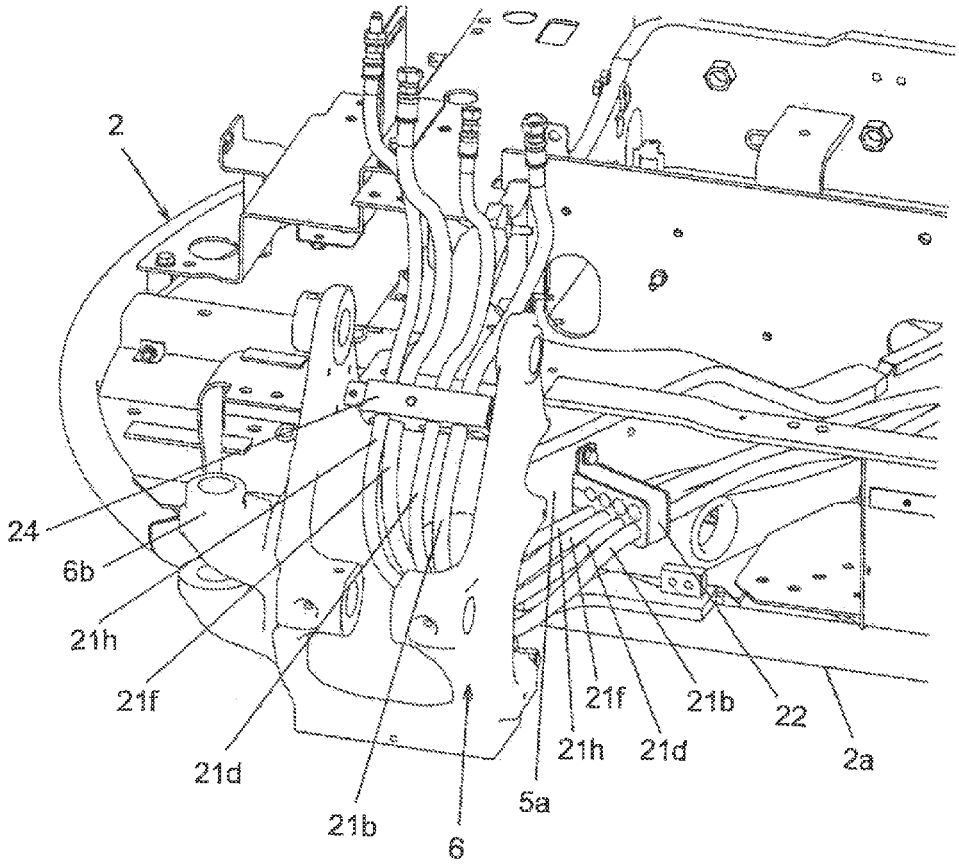
FIG. 9 is a perspective view of a attachment form of the other group of working device pipes that are included in the present embodiment.

As illustrated in FIGS. 7 and 9, the second clamp 24 is provided with a plurality of stages of holding portions including a first stage holding portion and a second stage holding portion that is disposed on a position lower than the first stage holding portion. The first stage holding portion clamps the boom pipe 21*g*, the arm pipe 21*f*, the bucket pipe 21*e*, the arm pipe 21*c*, and the spare pipe 21*a* that are arranged on the same row on the second clamp 24 in a horizontal direction from a side of a swing cylinder (not shown) toward a side of the horizontal hole 6*a* of the swing post 6. The second stage holding portion clamps the boom pipe 21*h*, the bucket pipe 21*d*, and the spare pipe 21*b* that are arranged on the same row on the second clamp 24 in a horizontal direction from a side of a swing cylinder (not shown) toward a side of the horizontal hole 6*a* of the swing post 6. In the present embodiment, the second clamp 24 also includes, for example, the first stage holding portion and the second stage holding portion only.

In the present embodiment, an arrangement form of the working device pipes to be arranged in an existing compact excavator is taken into account. Accordingly, as illustrated in FIG. 7, the second clamp 24 is configured to clamp the two arm pipes 21*c* and 21*f* in the first stage holding portion. If applying the present embodiment to a newly manufactured compact excavator, the second clamp 24 may be configured such that the arm pipe 21*f* of the pair of the arm pipes 21*c* and 21*f*, which is clamped by the second stage holding portion of the first clamp 21, is clamped by the second stage holding portion of the second clamp 24.

Figure 10:
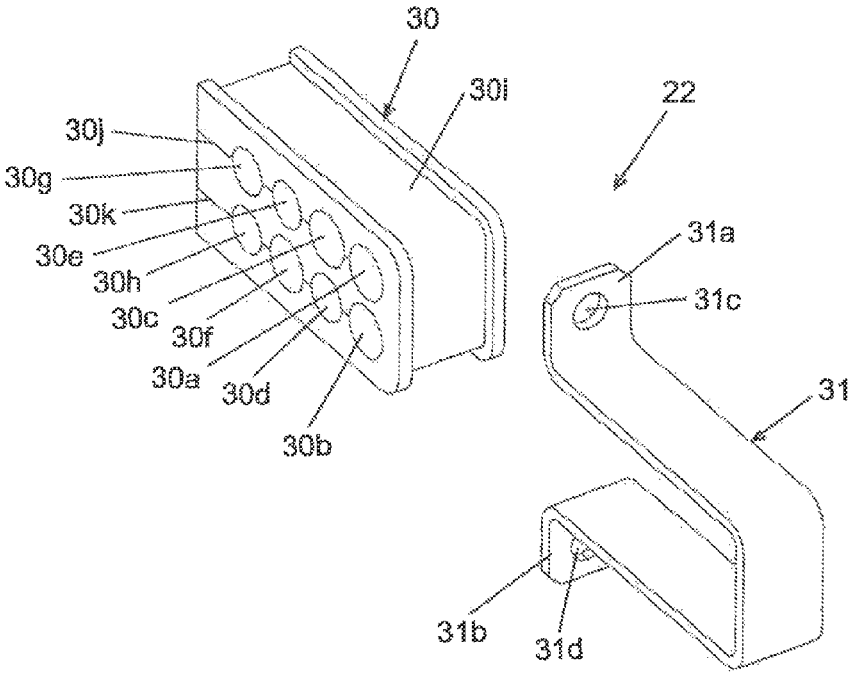
FIG. 10 is an exploded perspective view of a first clamp that constitutes a swing frame side holding body that is included in the present embodiment.

As illustrated in FIG. 10, the first clamp 22 is configured by a rubber 30 and a holding metal fitting 31. The rubber 30 includes holes that are arranged thereon. The holes into which the plurality of the working device pipes is inserted constitute the first stage holding portion of the first clamp. The holding metal fitting 31 holds the rubber 30 so as not to expand the rubber 30 and is fixed on the bracket 5 that is arranged on the swing frame 2*a*.

The rubber 30 includes holes 30*g*, 30*e*, 30*c*, and 30*a* that form the first stage holding portion, a slit 30*j* that makes the holes 30*g*, 30*e*, 30*c*, and 30*a* expandable when inserting the corresponding working device pipes thereto, holes 30*h*, 30*f*, 30*d*, and 30*b* that form the second stage holding portion, and a slit 30*k* that makes the holes 30*h*, 30*f*, 30*d*, and 30*b* expandable when inserting the corresponding working device pipes thereto, and a channel 30*i* into which the holding metal fitting 31 is fitted.

The boom pipe 21*g* is inserted into the hole 30*g* of the first stage holding portion of the rubber 30, the bucket pipe 21*e* is inserted into the hole 30*e*, the arm pipe 21*c* is inserted into the hole 30*c*, and the spare pipe 21*a* is inserted into the hole 30*a*. The boom pipe 21*h* is inserted into the hole 30*h* of the second stage holding portion of the rubber 30, the arm pipe 21*f* is inserted into the hole 30*f*, the bucket pipe 21*d* is inserted into the hole 30*d*, and the spare pipe 30*b* is inserted into the hole 30*b*.

The holding metal fitting 31 has the U-shape basically, and includes abutting portions 31*a* and 31*b*, which abut on a wall surface 5*a* of the bracket 5 illustrated in FIG. 6, on an upper and lower portions thereof respectively. On the abutting portions 31*a* and 31*b*, holes 31*c* and 31*d* into which bolts 46 and 47 (also illustrated in FIG. 6) for fixing the holding metal fitting 31 on the wall surface 5*a* of the bracket 5 are inserted are formed.

Figure 5:
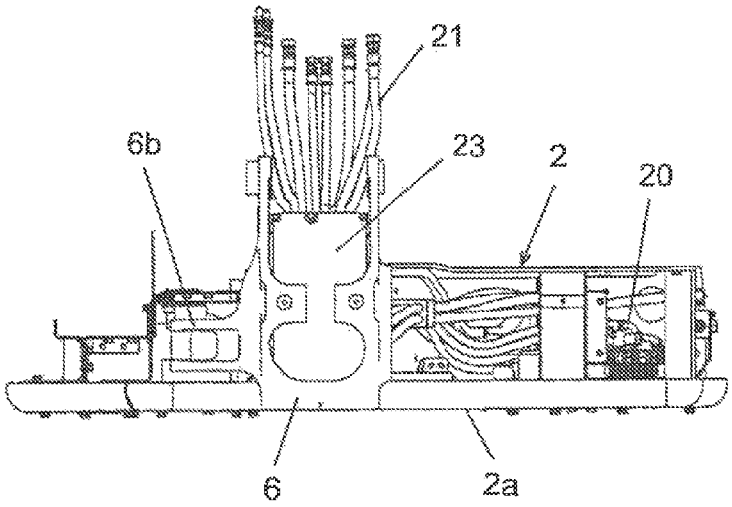
FIG. 5 is a front view of a main part of an embodiment according to the present invention.

In the present embodiment, as illustrated in FIGS. 2, 3, and 5, etc., a cover 23 on which the second clamp 24 is fixed and covers the second clamp 24 is arranged on the swing post 6.

Figure 11:
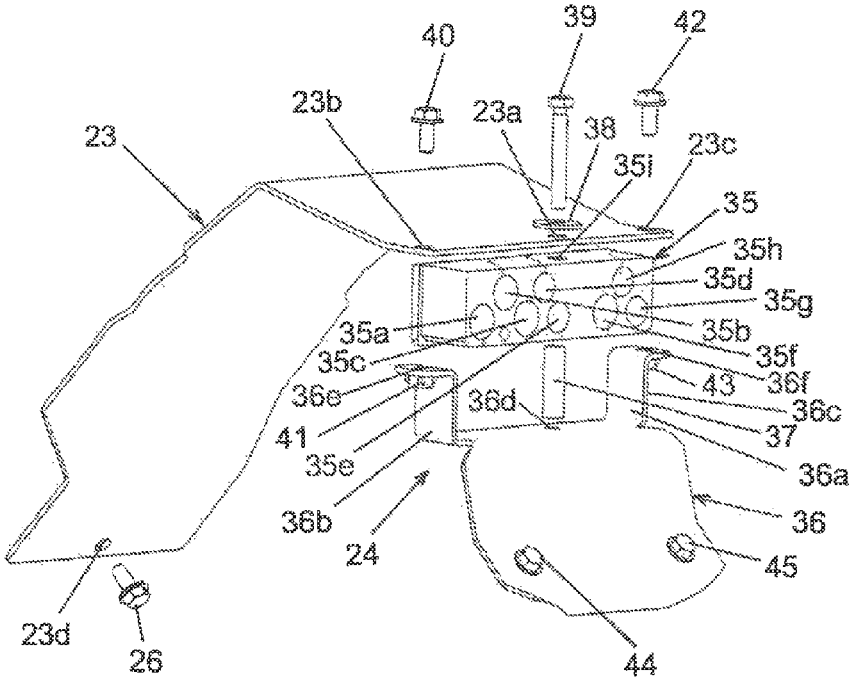
FIG. 11 is an exploded perspective view of a second clamp that constitutes a swing post side holding body that is included in the present embodiment.
Figure 12:
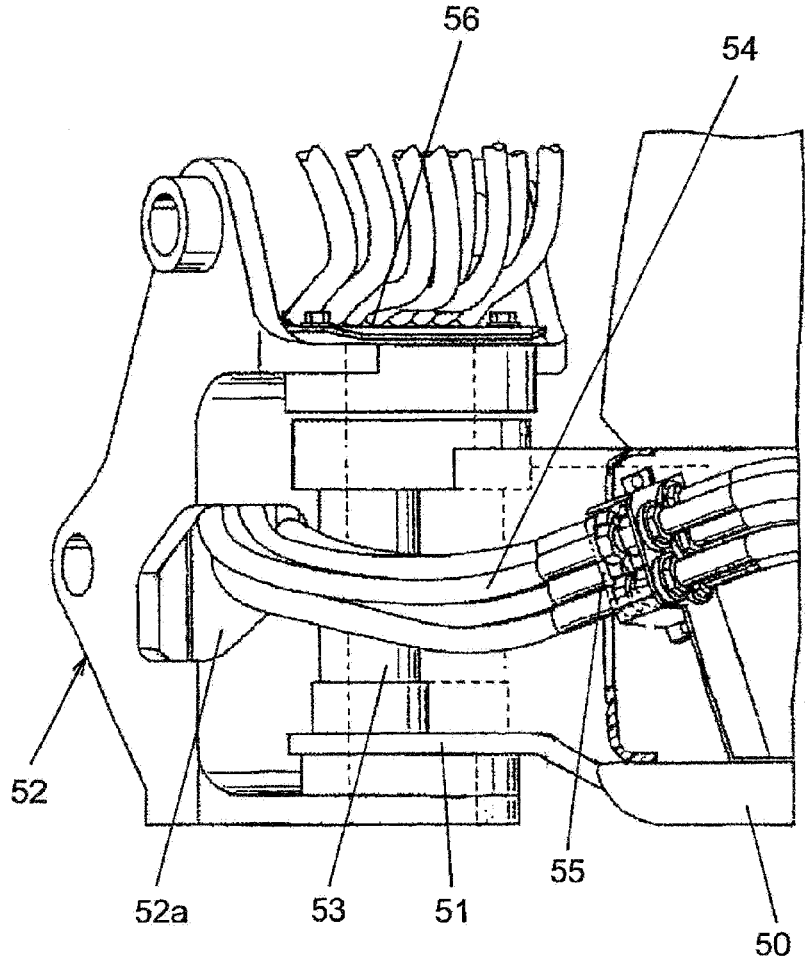
FIG. 12 is a perspective view of a main part of a conventional swing-type construction machine.
Figure 13:
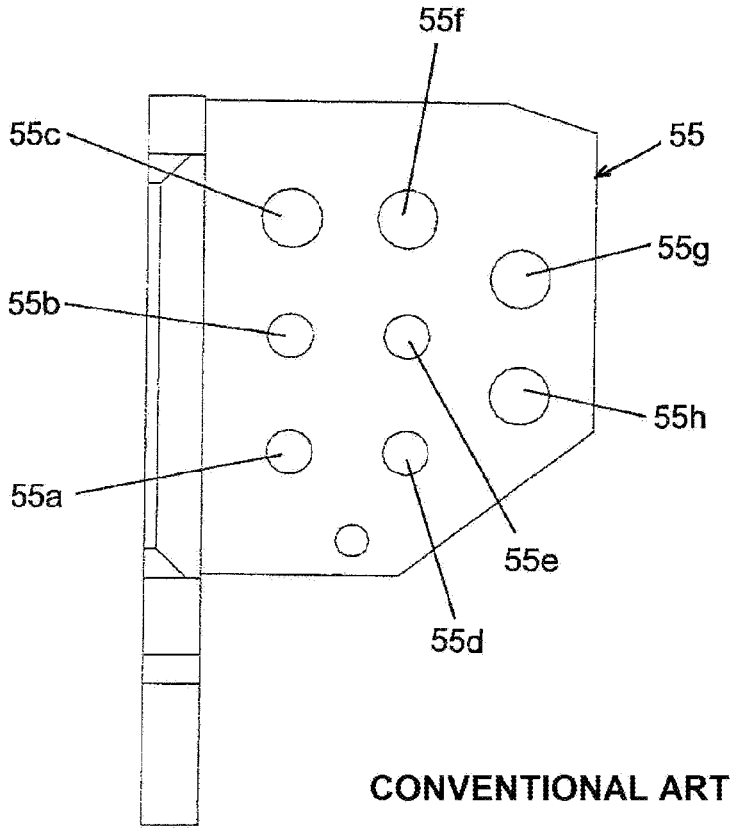
FIG. 13 is a front view of a pipe holding bracket that constitutes a swing frame side holding body that is included in the conventional swing-type construction machine illustrated in FIG. 12.
Figure 14:
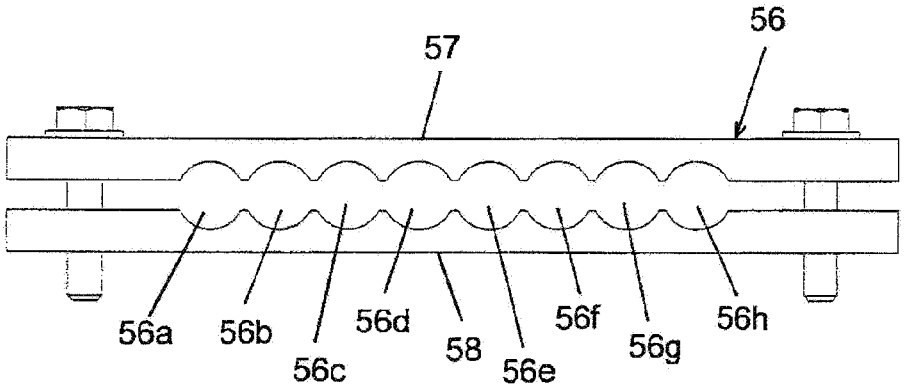
CONVENTIONAL ART FIG. 14
FIG. 14 is a front view of a clamp that constitutes a swing post side holding body that is included in the conventional swing-type construction machine illustrated in FIG. 12.

As illustrated in FIG. 11, the second clamp 24 is configured by a rubber 35 and a holding metal fitting 3. The rubber 35 includes holes that are arranged thereon. The holes to which the plurality of the working device pipes is inserted constitute the first stage holding portion and the second stage holding portion of the second clamp 24. The holding metal fitting 36 holds the rubber 35 so as not to expand the rubber 35 and is fixed on the cover 23.

As also illustrated in FIG. 11, a hole 23*d* is arranged on a lower portion of the cover 23, and the cover 23 is fixed on the swing post 6 by a bolt 26 that is inserted into the hole 23*d*.

The holding metal fitting 36 has a pair of legs 36*b* and 36*c* that form a concave portion 36*a* into which the rubber 35 is fitted and abutting portions that are respectively formed on each end of the legs 36*b* and 36*c* to abut the cover 23. The abutting portions include holes 36*e* and 36*f* that correspond respectively to holes 23*b* and 23*c* that are formed on the cover 23. On each back side of the abutting portions, nuts 41 and 43 that correspond respectively to the holes 36*e* and 36*f* are welded. A hole 35*i* into which a cylindrical member 37 is inserted is formed on the center of the rubber 35, a hole 23*a* that corresponds to the hole 35*i* is formed on the cover 23, and a hole 36*d* is formed on a position of the holding metal fitting 36, where the cylindrical member 35 corresponds. On a back side of the hole 36*d* which is apart of the holding metal fitting 36, a nut (not shown) is welded. The holding metal fitting 36 is configured to be fixed on the swing post 6 by bolts 45 and 46.

When mounting the second clamp 24 on the cover 23, the respective abutting portions of the legs 36*b* and 36*c* of the holding metal fitting 36 abut on the cover 23 such that the rubber 35 fits into the concave portion 36*a* in a state where the cylindrical member 37 is inserted into the hole 35*i* of the rubber 35. In this state, a bolt 39 is inserted into the hole 23*a* of the cover 23, the cylindrical member 37 that is inserted into the hole 35*i* of the rubber 35, and the hole 36*d* of the holding metal fitting 36 via a washer 38 to be screwed with a nut (not shown) that is welded on the back side of the holding metal fitting 36. Furthermore, a bolt 40 is inserted into the hole 23*b* of the cover 23 and the hole 36*e* of the abutting portion of the leg 36*b* of the holding metal fitting 36 to be screwed with a nut 41. Moreover, a bolt 42 is inserted into the hole 23*c* of the cover 23 and the hole 36*f* of the abutting portion of the leg 36*c* of the holding metal fitting 36 to be screwed with a nut 43.

The rubber 35 of the second clamp 24 includes holes 35*g*, 35*f*, 35*e*, 35*c*, and 35*a* that constitute the first stage holding portion of the second clamp 24, and holes 35*h*, 35*d*, and 35*b* that constitute the second stage holding portion of the second clamp 24. Slits that make these holes expandable when inserting the corresponding working device pipes thereto are formed on lower sides or upper sides of each hole.

The boom pipe 21*g* is inserted into the hole 35*g* of the first stage holding portion of the rubber 35, the arm pipe 21*f* is inserted into the hole 35*f*, the bucket pipe 21*e* is inserted into the hole 35*e*, the arm pipe 21*c* is inserted into the hole 35*c*, and the spare pipe 21*a* is inserted into the hole 35*a*. The boom pipe 21*h* is inserted into the hole 35*h* of the second stage holding portion of the rubber 35, the bucket pipe 21*d* is inserted into the hole 35*d*, and the spare pipe 21*b* is inserted into the hole 35*b*.

The present embodiment is configured as above, and accordingly the plurality of the working device pipes 21 to be inserted into the horizontal hole 6*a* of the swing post 6 are maintained basically in a two-stage group of the working device pipes in a vertical direction by cooperation of the first clamp 22 and the second clamp 24. There is a case in which, when the plurality of the working device pipes 21 expand outwardly along with an operation in which the working device 7 swings in an opposite direction against a side of a swing cylinder (not shown), the mutually adjacent working device pipes of a group of the working device pipes on the same upper row of the first clamp 22, which includes the spare pipe 21*a*, the arm pipe 21*c*, bucket pipe 21*e*, and the boom pipe 21*g*, come in contact with each other, or the mutually adjacent working device pipes of a group of the working device pipes on the same lower row of the second clamp 24, which includes the spare pipe 21*b*, the bucket pipe 21*d*, the arm pipe 21*f* and the boom pipe 21*h*, come in contact with each other. Even in such the case, with the configuration according to the present embodiment, sliding between the pipes is easily generated, and this sliding makes it possible to suppress transmission of force that is generated in accordance with the expanding action.

Furthermore, when the plurality of the working device pipes 21 expand outwardly as mentioned above, there is a case where either of the spare pipe 21*a*, the arm pipe 21*c*, the bucket pipe 21*e*, and the boom pipe 21*g* that are included in the group of the working device pipes on the same upper row of the first clamp 22 comes into contact with one or more pipes of the spare pipe 21*b*, the bucket pipe 21*d*, the arm pipe 21*f* and the boom pipe 21*h* that are included in the group of the working device pipes on the same lower row of the second clamp 24. Even in such the case, with the configuration according to the present embodiment, sliding between the pipes on the upper row and the pipes on the lower row is easily generated, and this sliding makes it possible to suppress transmission of force that is generated in accordance with the expanding action.

As described above, when the plurality of the working device pipes 21 respectively expand outwardly along with a swing operation of the working device 7, transmission of force to the spare pipes 21*a* and 21*b*, etc. that are located more outside than the other working device pipes, which is generated in accordance with the expanding action of the working device pipes that are located inside can be suppressed. That is, it is possible to reduce force of the working device pipes 21, which is generated along with a swing operation of the working device 7 and presses against an edge, etc. of the horizontal hole 6*a* of the swing post 6. Therefore, the present embodiment can improve durability of the working device pipes 21.

In the present embodiment, it is configured that the first clamp 22 includes the first stage holding portion and the second stage holding portion that hold the different groups of the working device pipes with each other. In this connection, when there is enough space left to accommodate the working device pipes 21 within the swing post 6, it may be configured such that the first clamp 22 includes a third stage holding portion for holding a group of the working device pipes on a position lower than the second stage holding portion. In this case, the second clamp 24 is also configured to include a third stage holding portion for holding a group of working device pipes. If configuring the first clamp 22 and the second clamp 24 as above, sliding between the pipes is also easily generated, and transmission of force to the working device pipes that are located outside, which is caused in accordance with the expanding action of the working device pipes that are located more inside, can be suppressed even when the mutually adjacent working device pipes come into contact with each other or even when the working device pipes positioned above and below come into contact with each other at the time of an outwardly expanding action of the plurality of the working device pipes 21 which is generated along with an operation in which the working device 7 swings in an opposite direction against a side of a swing cylinder (not shown). Therefore, when configuring the first clamp 22 and the second clamp 24 as above, it works the same way as the previously described embodiment and can obtain the same effect as well.

EXPLANATION OF REFERENCES

2 upperstructure
2*a* swing frame
5 bracket
5*a* wall surface
6 swing post
6*a* horizontal hole
6*b* mounting portion
7 working device
8 boom
9 arm

10 bucket
11 boom cylinder
12 arm cylinder
13 bucket cylinder
20 control valve
21 working device pipe
21*a* spare pipe
21*b* spare pipe
21*c* arm pipe
21*d* bucket pipe
21*e* bucket pipe
21*f* boom pipe
21*g* boom pipe
21*h* boom pipe
22 first clamp (swing frame side holding body)
23 cover
24 second clamp (swing post side holding body)
25 connecting pin
30 rubber
31 holding metal fitting
35 rubber
36 holding metal fitting

The invention claimed is:

1. A swing construction machine comprising:

a working device including a plurality of hydraulic actuators;

a swing cylinder that swings the working device in a horizontal direction;

a swing post that is rotatable in a horizontal direction and on which the working device is mounted;

a bracket that is connected to the swing post via a vertically extended connecting pin;

an upperstructure having a swing frame on which the bracket is fixed;

a control valve that is arranged on the upperstructure;

a plurality of working device pipes that connect the control valve with corresponding ones of the plurality of hydraulic actuators;

a swing frame side holding body that holds a part of the plurality of the working device pipes which is located at a side of the swing frame; and a swing post side holding body that holds a part of the plurality of the working device pipes which is located at a side of the swing post, the swing post having a horizontal hole into which the plurality of the working device pipes are inserted and is arranged on a position of an opposite side of a swing cylinder across from the connecting pin; and the plurality of the working device pipes being arranged such that they extend along a horizontal direction between the swing frame side holding body and the horizontal hole of the swing post, and when inserting the plurality of the working device pipes into the horizontal hole of the swing post, the plurality of the working device pipes are inserted therein so as to wrap around the connecting pin, and at a position upper than a position where the plurality of the working device pipes are inserted into the horizontal hole of the swing post, an extending direction of the plurality of the working device pipes is reversed, and in the reversed state, the plurality of the working device pipes are clamped by the swing post side holding body so that the plurality of the working device pipes extend upwardly thereafter, wherein, the swing frame side holding body is configured by a first clamp that is provided with a plurality of stages of holding portions including a first stage holding portion and a second stage holding portion, and the plurality of the stages of the holding portions respectively clamp corresponding pipes of the plurality of the working device pipes, the swing post side holding body is configured by a second clamp having a first stage holding portion for clamping the plurality of the working device pipes that are clamped by the first stage holding portion of the first clamp and a second stage holding portion for clamping the plurality of the working device pipes that are clamped by the second stage holding portion of the first clamp, the first clamp is configured by a rubber piece and a holding metal fitting, the rubber piece of the first clamp is provided with holes that constitute the first stage holding portion and the second stage holding portion of the first clamp and the holes into which the plurality of working device pipes are inserted are arranged in a row in a horizontal direction, the holding metal fitting of the first clamp holds the rubber piece of the first clamp so as not to expand the rubber piece of the first clamp, the second clamp is configured by a rubber piece and a holding metal fitting, the rubber piece of the second clamp is provided with holes that constitute the first stage holding portion and the second stage holding portion of the second clamp and the holes into which the plurality of working device pipes are inserted are arranged in a row in a horizontal direction, and the holding metal fitting of the second clamp holds the rubber piece of the second clamp so as not to expand the rubber piece of the second clamp.

2. The swing construction machine according to claim 1, wherein cover is provided for fixing the first clamp on the bracket and is arranged on the swing post, and the second clamp is fixed thereon to be covered thereby.

3. The swing construction machine according to claim 2, wherein the swing construction machine is an excavator that constitutes a construction machine, the working device includes a boom that is attached to the swing post swingably in a vertical direction, an arm that is attached to a top portion of the boom swingably in a vertical direction, and a bucket that is attached to a top portion of the arm swingably in a vertical direction, the working device is also provided with a boom cylinder for driving the boom, an arm cylinder for driving the arm, and a bucket cylinder for driving the bucket that constitute hydraulic actuators, the swing post includes a mounting portion of the swing cylinder on a position opposite to a side of the horizontal hole across from the connecting pin, and the working device pipes include a boom pipe to be connected to the boom cylinder, an arm pipe to be connected to the arm cylinder, and a bucket pipe to be connected to the bucket cylinder.

4. The swing construction machine according to claim 3, wherein the swing construction machine is configured such that it includes the two boom pipes, the two arm pipes, and the two bucket pipes, in the first clamp, one of the two boom pipes, one of the two arm pipes, and one of the two bucket pipes are inserted into the holes that constitute the first stage holding portion of the first clamp, while the other one of the two boom pipes, the other one of the two arm pipes, and the other one of the two bucket pipes are inserted into the holes that constitute the second stage holding portion of the first clamp, and in the second clamp, the boom pipe, the arm pipe, and the bucket pipe that are inserted into the holes that constitute the first stage holding portion of the first clamp and the arm pipe that is inserted into the hole that constitutes the second stage holding portion of the first clamp are inserted into the holes that constitute the first stage holding portion of the second clamp, while the boom pipe and the bucket pipe that are inserted into the holes that constitute the second stage holding portion of the first clamp are inserted into the holes that constitute the second stage holding portion of the second clamp.

* * * * *